US010364011B2

(12) United States Patent
Kato et al.

(10) Patent No.: US 10,364,011 B2
(45) Date of Patent: Jul. 30, 2019

(54) ENGINE CONTROL APPARATUS AND VESSEL EQUIPPED WITH THE ENGINE CONTROL APPARATUS

(71) Applicant: Mitsubishi Electric Corporation, Tokyo (JP)

(72) Inventors: Seiji Kato, Tokyo (JP); Hisanori Nobe, Tokyo (JP)

(73) Assignee: Mistubishi Electric Corporation, Chiyoda-ku, Tokyo (JP)

( * ) Notice: Subject to any disclaimer, the term of this patent is extended or adjusted under 35 U.S.C. 154(b) by 306 days.

(21) Appl. No.: 15/475,397

(22) Filed: Mar. 31, 2017

(65) Prior Publication Data

US 2018/0118319 A1 May 3, 2018

(30) Foreign Application Priority Data

Oct. 31, 2016 (JP) ..... 2016-212479

(51) Int. Cl.

| | |
|---|---|
| ***B63H 21/21*** | (2006.01) |
| ***B63H 21/14*** | (2006.01) |
| ***F02N 11/08*** | (2006.01) |
| ***B63B 35/73*** | (2006.01) |
| *F02P 11/00* | (2006.01) |

(52) U.S. Cl.

CPC ..... *B63H 21/213* (2013.01); *B63B 35/731* (2013.01); *B63H 21/14* (2013.01); *F02N 11/087* (2013.01); *F02N 11/0862* (2013.01); *B63B 2758/00* (2013.01); *B63H 2021/216* (2013.01); *F02P 11/00* (2013.01)

(58) Field of Classification Search

CPC .... F02N 11/0862; F02N 11/087; F02N 15/10; F02P 11/00; B63B 2758/00; B63B 35/731; B63H 21/14; B63H 21/213; B63H 2021/216

See application file for complete search history.

(56) References Cited

U.S. PATENT DOCUMENTS

| | | | | |
|---|---|---|---|---|
| 6,708,101 | B2 * | 3/2004 | Umemoto | B60R 16/023 123/650 |
| 2009/0319106 | A1 | 12/2009 | Ichikawa et al. | |
| 2010/0256897 | A1 * | 10/2010 | Takata | B60R 25/04 701/113 |
| 2012/0060786 | A1 * | 3/2012 | Okada | F02N 11/087 123/179.5 |

FOREIGN PATENT DOCUMENTS

| | | |
|---|---|---|
| JP | 2010-007498 A | 1/2010 |

* cited by examiner

*Primary Examiner* — Hung Q Nguyen
*Assistant Examiner* — Mark L. Greene
(74) *Attorney, Agent, or Firm* — Sughrue Mion, PLLC; Richard C. Turner

(57) ABSTRACT

When a main switch is turned on, a main relay is energized so as to supply electric power to a computer system; when an engine starting switch is turned on, an engine is started and energization of the main relay is continued; when an engine stopping switch is turned on, the engine is stopped, and the main relay is de-energized so as to stop supply of electric power to the computer system.

4 Claims, 3 Drawing Sheets

ENGINE CONTROL APPARATUS AND VESSEL EQUIPPED WITH THE ENGINE CONTROL APPARATUS

BACKGROUND OF THE INVENTION

Field of the Invention

The present invention relates to an engine control apparatus mounted in a vessel such as a small-sized planing boat or in a motorcycle or the like and to a vessel equipped with the engine control apparatus.

Description of the Related Art

A vessel such as a small-sized boat equipped with an engine is provided with an engine control unit (referred to as an ECU, hereinafter) having a computer system such as a microcomputer (referred to as a MICOM, hereinafter) and with a remote control unit (referred to as a REMOCON, hereinafter). Conventionally, such a vessel is usually provided with an engine control apparatus including a main switch for supplying a power source to a computer system in the ECU, an engine starting switch, for making the engine start, that is connected in series with the main switch, and an engine stopping switch for making the engine stop.

With regard to the foregoing engine control apparatus in a conventional vessel, there has been disclosed a technology (e.g., refer to Patent Document 1) in which when the engine is started, both the main switch and the engine starting switch are closed so as to output a Wakeup signal to the MICOM of the ECU, through a microcomputer in the REMOCON, in which a power-source switching device is activated so as to turn on a main relay, in which electric power is supplied from a battery mounted in the vessel to the ECU so as to start the MICOM and to activate the engine.

In the engine control apparatus, in a conventional vessel, that is disclosed in Patent Document 1, by closing the engine stopping switch so as to turn off the main relay, the battery is stopped from supplying electric power and hence the computer system of the ECU is stopped from outputting, so that even when the main switch has been closed, the engine can be stopped. Then, when the engine is stopped, the computer systems in the ECU and the REMOCON are reset to stop in order to suppress the power consumption in the battery.

Meanwhile, in the case of a vessel having a large body, because the power supplying cable from the battery is long, the supply voltage to the ECU decreases and hence the computer system may be reset to stop; however, even in that case, the engine can securely be started, because in the conventional engine control apparatus disclosed in Patent Document 1, both the main switch and the engine starting switch are closed.

PRIOR ART REFERENCE

Patent Document

[Patent Document 1] Japanese Patent Application Laid-Open No. 2010-7498

However, in the case of the conventional engine control apparatus in a vessel, disclosed in Patent Document 1, because the main switch for turning on the main power source and the engine starting switch for starting the engine are connected in series with each other, the computer system in the ECU and the engine are started at the same time; thus, there has been a problem that the condition of the engine cannot be ascertained before the engine starts.

The foregoing problem can simply be solved, for example, by providing, in the ECU, a wiring lead for connecting the main switch with the power-supply circuit for the computer system of the ECU. In this case, in order to stop the computer system of the ECU, it is required to turn off the main switch. However, for example, in some vessels such as a small-sized planing boat and the like, the main switch for the main power source and the engine stopping switch for stopping the engine are arranged in such a way as to be apart from each other; therefore, it is common that when the engine is stopped, only the engine stopping switch is turned off, but the main switch for the main power source is not turned off in each case.

Accordingly, in the case where the wire lead for connecting the main switch with the power-supply circuit for the computer system of the ECU is provided in the ECU, the main switch for the main power source is left turned on and hence the computer system of the ECU cannot be turned off; thus, because suppression of power consumption in the battery is deteriorated, there is posed a problem that the energy-saving function cannot sufficiently be exerted.

The present invention has been implemented in order to solve the foregoing problems in conventional engine control apparatuses; the objective thereof is to provide an engine control apparatus that can ascertain the condition of an engine before the engine starts and can suppress power consumption in the main power source so as to sufficiently exert the energy-saving function and to provide a vessel equipped with the engine control apparatus.

SUMMARY OF THE INVENTION

An engine control apparatus according to the present invention includes an engine control unit including a computer system that performs operation control including starting and stopping of an engine, a main switch that opens or closes a main power source for supplying a power source to the engine control unit, an engine starting switch that is turned on when the engine is started, an engine stopping switch that is turned on when the engine is stopped, and a main relay that supplies a power source from the main power source to the computer system when energized and that stops supply of the power source when de-energized; the engine control apparatus is characterized in that when the main switch is on, the engine control unit generates a main relay ON command so as to energize the main relay and to supply electric power to the computer system, in that when the engine starting switch is turned on, the engine control unit starts the engine and generates the main relay ON command so as to continue to energize the main relay, and in that when the engine stopping switch is turned on, the engine control unit stops the engine, generates a main relay OFF command so as to de-energize the main relay even when the main switch is on, in order to stop supply of electric power to the computer system, and continues to generate the main relay OFF command even after the engine stops.

Moreover, a vessel according to the present invention is characterized by including an engine control apparatus that has an engine control unit including a computer system that performs operation control including starting and stopping of an engine, a main switch that opens or closes a main power source for supplying a power source to the engine control unit, an engine starting switch that is turned on when the engine is started, an engine stopping switch that is turned on when the engine is stopped, and a main relay that supplies a power source from the main power source to the computer system when energized and that stops supply of the power source when de-energized and in which when the main switch is on, the engine control unit generates a main relay ON command so as to energize the main relay and to supply electric power to the computer system, in which when the engine starting switch is turned on, the engine control unit starts the engine and generates the main relay ON command so as to continue to energize the main relay, and in which when the engine stopping switch is turned on, the engine control unit stops the engine, generates a main relay OFF command so as to de-energize the main relay even when the main switch is on, in order to stop supply of electric power to the computer system, and continues to generate the main relay OFF command even after the engine stops.

Furthermore, a vessel according to the present invention is characterized in that in the case where when the main switch is on and generation of the main relay OFF command is continued, the engine starting switch is turned on, the engine control unit energizes the main relay so as to start supply of the power source to the computer system.

The engine control apparatus according to the present invention includes an engine control unit including a computer system that performs operation control including starting and stopping of an engine, a main switch that opens or closes a main power source for supplying a power source to the engine control unit, an engine starting switch that is turned on when the engine is started, an engine stopping switch that is turned on when the engine is stopped, and a main relay that supplies a power source from the main power source to the computer system when energized and that stops supply of the power source when de-energized; the engine control apparatus is configured in such a way that when the main switch is on, the engine control unit generates a main relay ON command so as to energize the main relay and to supply electric power to the computer system, in such a way that when the engine starting switch is turned on, the engine control unit starts the engine and generates the main relay ON command so as to continue to energize the main relay, and in such a way that when the engine stopping switch is turned on, the engine control unit stops the engine, generates a main relay OFF command so as to de-energize the main relay even when the main switch is on, in order to stop supply of electric power to the computer system, and continues to generate the main relay OFF command even after the engine stops. Therefore, because the power source can be supplied to the computer system before the engine is started, the condition of the engine can be ascertained before the engine is started. Moreover, when the main switch is on, the main relay is turned on and this state is maintained; thus, it is made possible that by stopping the supply of electric power to the computer system, the power consumption in the main power source is suppressed and hence the energy-saving effect is enhanced.

Furthermore, because the vessel according to the present invention is equipped with the engine control apparatus, it is made possible to supply the power source to the computer system; thus, the condition of the engine can be ascertained before the engine is started. Moreover, when the main switch is on, the main relay is turned on and this state is maintained; thus, it is made possible that by stopping the supply of electric power to the computer system, the power consumption in the main power source is suppressed and hence the energy-saving effect is enhanced.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
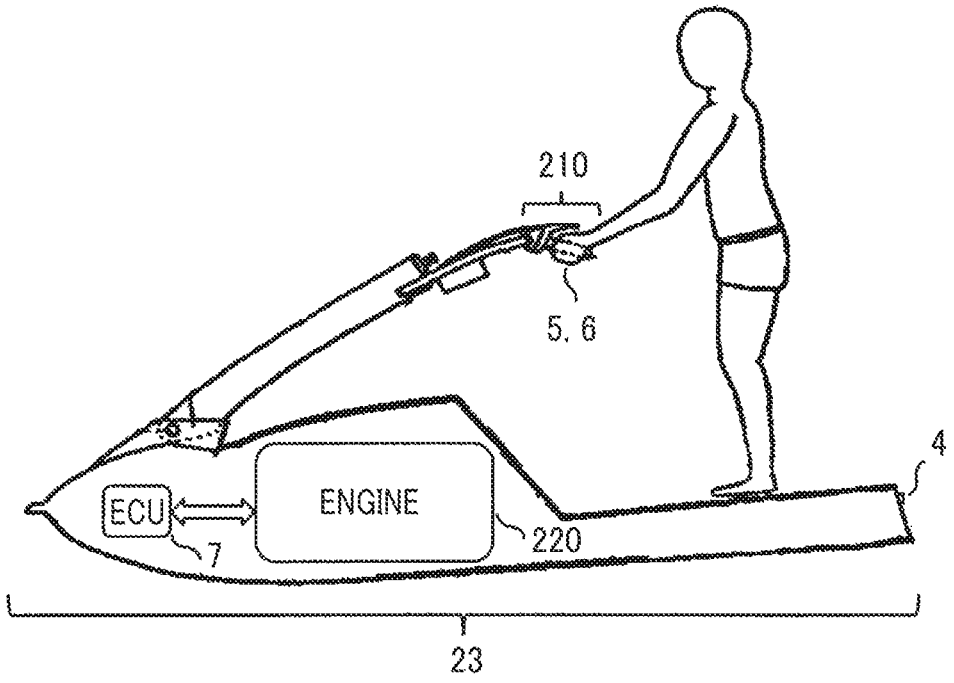
FIG. 1 is an explanatory view illustrating an engine control apparatus according to Embodiment 1 of the present invention and a vessel equipped with the engine control apparatus.

Hereinafter, an engine control apparatus according to Embodiment 1 of the present invention and a vessel propulsion apparatus equipped with the engine control apparatus will be explained based on the drawings. FIG. 1 is an explanatory view illustrating the engine control apparatus according to Embodiment 1 of the present invention and a small-sized planing boat having a vessel propulsion apparatus equipped with the engine control apparatus. In FIG. 1, a small-sized planing boat 23 as a vessel is equipped with a vessel propulsion apparatus including an engine 220 and an ECU 7. The ECU 7 is included in the engine control apparatus according to Embodiment 1 of the present invention and is provided with a computer system, configured with a MICOM and the like, that performs operation control including starting and stopping of the engine 220.

In the small-sized planing boat 23, a cranking switch 5 as an engine starting switch for starting the engine 220 and an engine stopping switch 6 for stopping the engine 220 are provided in the vicinity of a handle 210 to be operated by an operator. The cranking switch 5 and the engine stopping switch 6 are included in part of a so-called REMOCON. A main switch 4 is to turn on or off a main power source that supplies a power source to the computer system of the ECU 7; the main switch 4 is provided at the rear end of the small-sized planing boat 23 and is situated under the feet of the operator.

Figure 2:
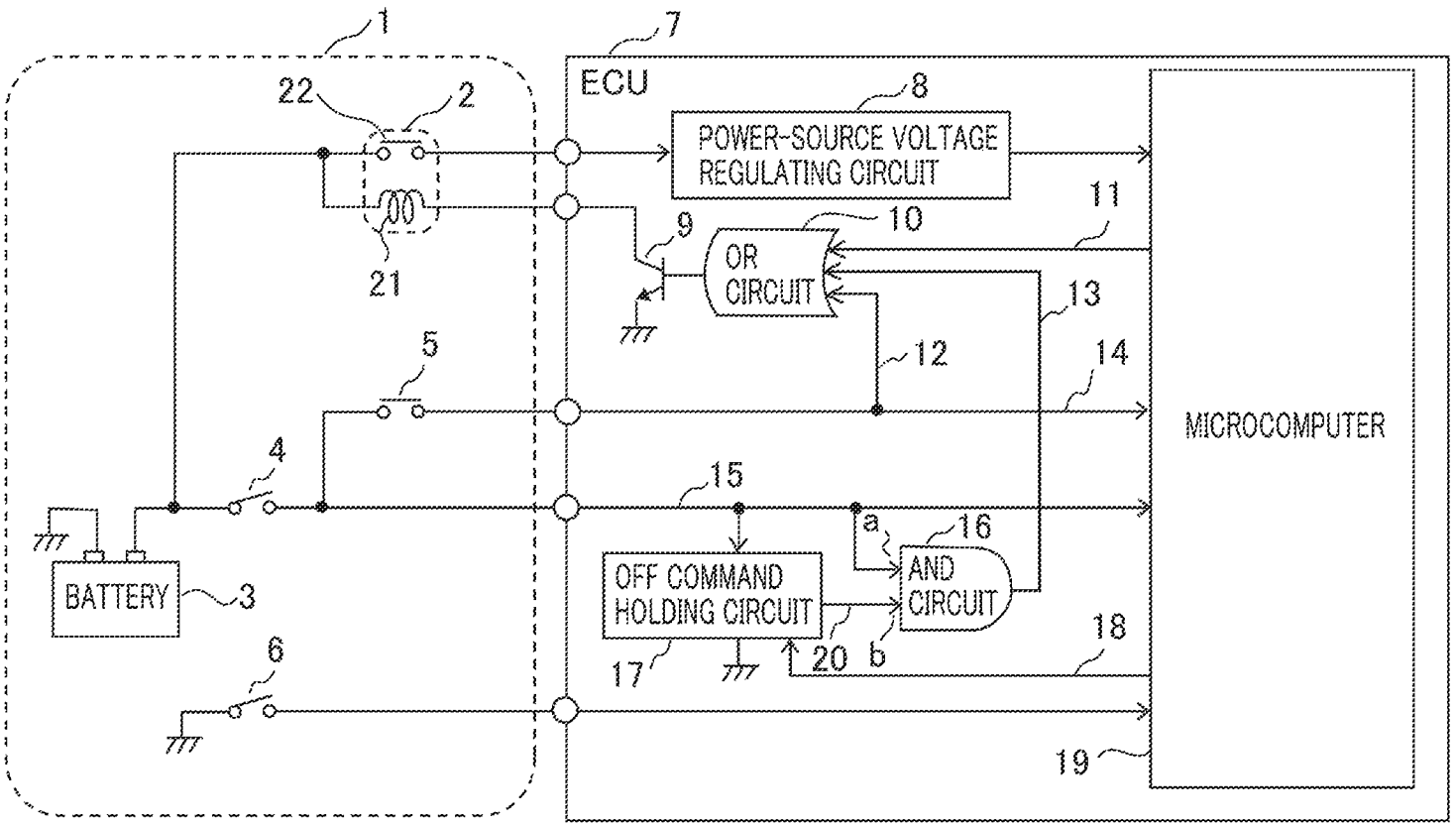
FIG. 2 is a block diagram representing the engine control apparatus according to Embodiment 1 of the present invention.

FIG. 2 is a block diagram representing the engine control apparatus according to Embodiment 1 of the present invention; the block diagram represents the ECU 7 mounted in the vessel propulsion apparatus of the small-sized planing boat 23 and a switch circuit unit 1 connected with the ECU 7. In FIG. 2, the switch circuit unit 1 is provided in the small-sized planing boat 23 and is provided with a battery 3, the main switch 4, the cranking switch 5 as a starting switch, a main relay 2, and the engine stopping switch 6.

One of the terminals of the main switch 4 is connected with the positive-polarity electrode of the battery 3; the other one of the terminals of the main switch 4 is connected with a command path 15 leading to a MICOM 19, described later. One of the terminals of the cranking switch 5 is connected with the other one of the terminals of the main switch 4; the other one of the terminals of the cranking switch 5 is connected with a command path 14 leading to the after-mentioned MICOM 19 and with a command path 12 connected with a third input terminal of an after-mentioned OR circuit 10. One of the terminals of the engine stopping switch 6 is connected with the negative-polarity electrode of the battery 3; the other one of the terminals of the engine stopping switch 6 is connected with an input terminal of the after-mentioned MICOM 19. The cranking switch 5 is formed of a push-type normally opened contact.

The main relay 2 includes a relay coil 21 and a relay contact 22. One of the terminals of the relay coil 21 is connected with the positive-polarity electrode of the battery 3; the other one of the terminals of the relay coil 21 is connected with the collector terminal of a load driving transistor 9 as an after-mentioned switching device. One of the terminals of the relay contact 22 is connected with the positive-polarity electrode of the battery 3; the other one of the terminals of the relay contact 22 is connected with an after-mentioned power-source voltage regulating circuit.

Next, the ECU 7 includes the power-source voltage regulating circuit 8, the load driving transistor 9, the OR circuit 10, an AND circuit 16, an OFF command holding circuit 17, and the MICOM 19. The power-source voltage regulating circuit 8 is connected with the other one of the terminals of the relay contact 22 of the main relay 2; the power-source voltage regulating circuit 8 adjusts the power-source voltage from the battery 3 to a predetermined voltage and inputs the predetermined voltage to the MICOM 19. The collector terminal of the load driving transistor 9 as a switching device is connected with the other one of the terminals of the relay coil 21 of the main relay 2; the emitter terminal thereof is connected with the ground level, which is the electric potential of the negative-polarity electrode of the battery 3; the base terminal thereof is connected with the output terminal of the OR circuit 10; the load driving transistor 9 is on-controlled or off-controlled based on the output signal of the OR circuit 10.

The OR circuit 10 is provided with a first input terminal, a second input terminal, and a third input terminal; the first input terminal is connected with a command path 11 leading to the MICOM 19; the second input terminal is connected with a command path 13 leading to the AND circuit 16; the third input terminal is connected with the command path 12 connected with the other one of the terminals of the cranking switch 5. The command path 12 connected with the third input terminal of the OR circuit 10 is to transmit an ON-command or OFF-command to the load driving transistor 9, based on ON-information or OFF-information on the cranking switch 5; for example, the ON-command is formed of a high-level signal, and the OFF-command is formed of a low-level signal.

When the MICOM 19 once issues a main relay OFF command through a command path 18, the OFF command holding circuit 17 continues to output the main relay OFF command to a command path 20. In this situation, the main relay OFF command outputted through the command path 20 is formed of a low-level signal. The AND circuit 16 is provided with a first input terminal a and a second input terminal b; the first input terminal a is connected with the command path 15 leading to the main switch 4; the second input terminal b is connected with the command path 20 leading to the OFF command holding circuit 17. When both the signals inputted to the first input terminal a and the second input terminal b are high-level signals, a high-level signal is outputted from the output terminal; when a low-level signal is inputted to at least one of the input terminals, a low-level signal is outputted from the output terminal.

The MICOM 19 mounted in the ECU 7 that controls the engine 220 of the vessel propulsion apparatus receives a predetermined voltage from the power-source voltage regulating circuit 8, the ON-information or OFF-information on the cranking switch 5 through the command path 14, and ON-information or OFF-information on the engine stopping switch 6. Based on these inputted information pieces, the MICOM 19 provides, through the command path 11, a command for turning on or off the load driving transistor 9 to the first input terminal of the OR circuit 10. Furthermore, the MICOM 19 provides, through the command path 18, a command for holding the off state of the load driving transistor 9 to the OFF command holding circuit 17.

Next, there will be explained the operation of the engine control apparatus, configured as described above, according to Embodiment 1 of the present invention and the vessel propulsion apparatus equipped with the engine control apparatus. In FIGS. 1 and 2, before the main switch 4 is turned on, the MICOM 19 is in a stop state; thus, the MICOM 19 does not issue the main relay OFF command to the OFF command holding circuit 17. In this situation, because the main switch 4 is opened, no high-level signal is provided to the first input terminal a of the AND circuit 16; thus, no output signal as a high-level signal is generated from the output terminal.

Before the main switch 4 is turned on, the MICOM 19 has not issued a main relay ON command to the first input terminal of the OR circuit 10, through the command path 11, the high-level signal from the AND circuit 16 has not been inputted to the second input terminal, as described above, and the cranking switch 5 has been opened; therefore, no high-level signal is inputted to the third input terminal. As a result, the OR circuit 10 does not output any high-level signal and hence the load driving transistor 9 remains off; thus, no electric current is supplied to the relay coil 21 of the main relay 2 and hence the main relay 2 remains off.

In this situation, when the main switch 4 is turned on, a high-level signal as the main relay ON command is inputted to the first input terminal a of the AND circuit 16 through the command path 15, and the OFF command holding circuit 17 receives the high-level signal as the main relay ON command through the command path 15. When receiving the main relay ON command, the OFF command holding circuit 17 generates an output signal as a high-level signal and inputs the output signal to the second input terminal b of the AND circuit 16. As a result, because the AND circuit 16 outputs a high-level signal and inputs the high-level signal to the second input terminal of the OR circuit 10 through the command path 13, the OR circuit 10 outputs a high-level signal and provides the high-level signal to the base terminal of the load driving transistor 9, so that the load driving transistor 9 is turned on.

When the load driving transistor 9 is turned on, the battery 3 energizes the relay coil 21 of the main relay 2, so that the relay contact 22 is turned on. As a result, the power-source voltage regulating circuit 8 adjusts the output voltage of the battery 3 and then inputs a predetermined voltage to the MICOM 19, so that the ECU 7 is activated. When activated, the ECU 7 provides the main relay ON command to the first input terminal of the OR circuit 10 through the command path 11. Accordingly, the OR circuit 10 continues to output the high-level signal from the output terminal thereof so as to make the load driving transistor 9 remain on. As a result, the relay contact 22 of the main relay 2 remains on and hence the power-source voltage is continuously supplied to the MICOM 19.

As described above, by turning on the main switch 4, the ECU 7 can be activated; thus, the ECU 7 can be activated before the engine is started. As a result, for example, it is made possible that the MICOM 19 transmits the condition of the engine 220 to various kinds of meters mounted in the small-sized planing boat 23 so that the meters can display the condition of the engine; thus, the operator can ascertain the condition of the engine before the engine is started.

Moreover, because before the engine 220 is started, the ECU 7 can be activated, it is made possible that even in the case of an inexpensive vessel such as a planing boat equipped with no meters, the condition of the engine is ascertained before the engine is started by, for example, making the MICOM 19 light or blink an LED or sound a buzzer for warning of fuel shortage so that the condition of the engine and the like are transmitted to the operator.

Furthermore, because before the engine is started, the ECU 7 can be activated, the engine 220 can readily be started by, for example, making the MICOM 19 drive a fuel ignition apparatus (unillustrated) so that a small amount of fuel is injected into the cylinder of the engine 220 and then, as described later, making the cranking switch 5 start the engine 220 start.

Next, when the engine 220 is started, the cranking switch 5 is turned on while the main switch 4 is closed, as described above. When the cranking switch 5 is turned on, a signal is inputted to the third input terminal of the OR circuit 10 and the MICOM 19 from the battery 3 through the main switch 4 and the command path 12. As a result, because the MICOM 19 generates a starting command, the engine 220 can be activated.

While the engine rotates, in addition to supply of the main relay ON command through the command path 13, the main relay ON command from the MICOM 19 is inputted to the first terminal of the OR circuit 10 through the command path 11. In this situation, because the cranking switch 5 is a push-type switch, the signal to be received through the command path 12 is usually off; thus, the OR circuit 10 receives no signal.

Based on the high-level signal to be received through at least one of the command path 11 and the command path 13, the output signal from the OR circuit 10 becomes a high-level signal; the high-level signal from the OR circuit 10, as the main relay ON command, is provided to the base terminal of the load driving transistor 9. As a result, the load driving transistor 9 is turned on and hence the relay contact 22 of the main relay 2 is closed; thus, the supply of power source to the ECU 7 is maintained.

Moreover, because as described above, the MICOM 19 provides the main relay ON command to the first input terminal of the OR circuit 10 through the command path 11, the engine can be prevented from inappropriately stopping, even when, for example, due to loose contact of the main switch 4, it is unintentionally determined that the main switch 4 has been turned off and hence the AND circuit 16 does not output the main relay ON command through the command path 13.

Next, in the case where the engine 220 in a rotation is stopped, the engine stopping switch 6 is turned on. Accordingly, the MICOM 19 issues a command for stopping the engine so that the engine 220 is stopped. In this situation, after issuing the stopping command for the engine, the MICOM 19 counts the engine stopping period even when the main switch 4 is on; when the engine stopping period reaches a predetermined counting value, the MICOM 19 inputs a low-level signal as the main relay OFF command to the first input terminal of the OR circuit 10 through the command path 11 and provides the main relay OFF command to the OFF command holding circuit 17 through the command path 18.

When receiving the main relay OFF command from the MICOM 19 through the command path 18, the OFF command holding circuit 17 provides the main relay OFF command formed of a low-level signal to the second input terminal b of the AND circuit 16 through the command path 20. As a result, the output signal of the AND circuit 16 becomes a low-level signal, which is inputted to the second input terminal of the OR circuit 10 through the command path 13. In this situation, the cranking switch 5 formed of a push-type switch is held to be off; thus, a low-level signal is inputted to the third input terminal of the OR circuit 10 through the command path 12.

As described above, when the engine stopping switch 6 is turned on, the engine 220 is stopped, and, concurrently, respective low-level signals are inputted to all of the input terminals of the OR circuit 10. As a result, the output signal of the OR circuit 10 becomes a low-level signal and hence the load driving transistor 9 is turned off. Accordingly, the main relay 2 is turned off and hence the ECU 7 becomes off because the power supply from the battery 3 is stopped.

Because when the MICOM 19 once outputs the main relay OFF command through the command path 18, the OFF command holding circuit 17 continues to output the main relay OFF command to the command path 20, the AND circuit 16 continues to output a low-level signal even when the ECU 7 is stopped and hence the MICOM 19 does not output the main relay OFF command through the command path 18. Accordingly, even when the main switch 4 remains on and a high-level signal is inputted to the first input terminal a of the AND circuit 16, the ECU 7 can be stopped; thus, the consumption current of the battery 3 can be suppressed.

In the case where in the small-sized planing boat 23 illustrated in FIG. 1, an operator stops the engine 220, the operator usually operates the engine stopping switch 6 in the vicinity of the handle 210 so as to stop the engine 220 and then departs from the small-sized planing boat 23. Accordingly, it is a common custom that the main switch 4 is not turned off each time the engine is stopped.

Embodiment 1 of the present invention makes it possible that as described above, even in the case where the main switch 4 is not turned off when the engine is stopped, the ECU 7 can be stopped while the main switch 4 remains on; therefore, the energy-saving function of suppressing the consumption current of the battery 3 can more effectively be exerted.

As described above, because when the ECU 7 is stopped, neither the main relay ON command nor the main relay OFF command from the MICOM 19 is generated in the command path 11, no high-level signal for the OR circuit 10 is outputted. In this situation, when the cranking switch 5 is turned on, the main relay ON command as a high-level signal is inputted to the third input terminal of the OR circuit 10 through the command path 12; the load driving transistor 9 is turned on; the main relay 2 is turned on; the battery 3 supplied the power-source voltage to the power-source voltage regulating circuit 8; a predetermined voltage obtained through adjustment by the power-source voltage regulating circuit 8 is provided to the MICOM 19; then, the ECU 7 is activated. Then, at the same time when the ECU 7 is activated, information that has turned on the cranking switch 5 is inputted to the MICOM 19 through the command path 14; the MICOM 19 issues the command for starting the engine; then, the engine is restarted.

In the case where when the stopping state of the ECU 7 is held, i.e., when the OFF command holding circuit 17 continues to output the main relay OFF command to the command path 20, the main switch 4 is turned off, electric power is not supplied to the command path 15; the OFF command holding circuit 17 is reset; then, the main relay OFF command that has been being outputted to the command path 20 is cancelled.

Figure 3:
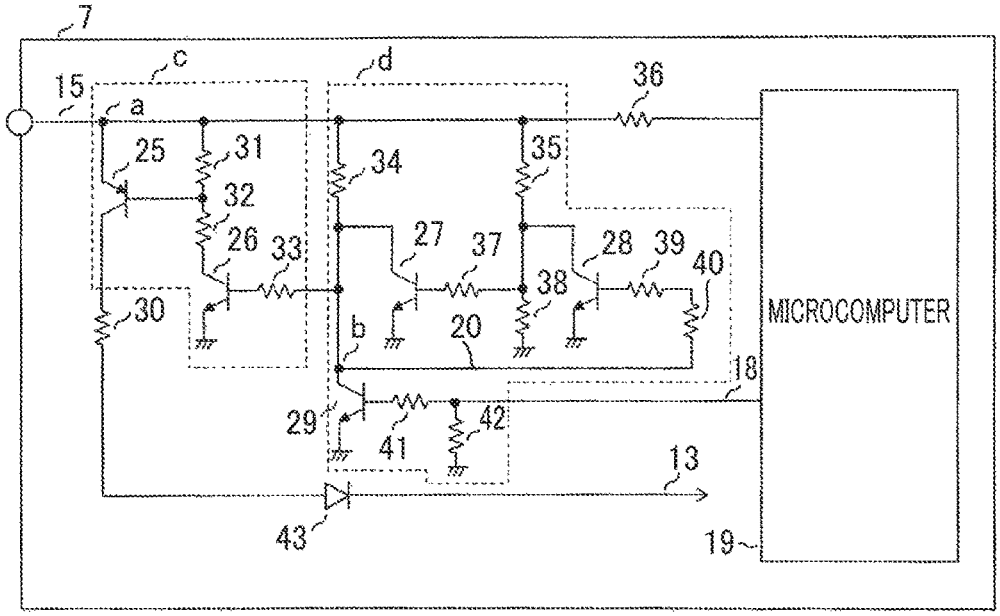
FIG. 3 is a circuit diagram representing part of an engine control unit in the engine control apparatus according to Embodiment 1 of the present invention.

FIG. 3 is a circuit diagram representing part of the engine control unit in the engine control apparatus according to Embodiment 1 of the present invention; FIG. 3 represents the details of the circuit configuration including the OFF command holding circuit 17 and the AND circuit 16. In FIG. 3, a circuit configuration unit c corresponds to the AND circuit 16 in FIG. 2; a circuit configuration unit d corresponds to the OFF command holding circuit 17 in FIG. 2; a point a corresponds to the first input terminal a of the AND circuit 16 in FIG. 2; a point b corresponds to the second input terminal b of the AND circuit 16 in FIG. 2. In FIG. 3, a command path 15 corresponds to the command path 15 in FIG. 2; a command path 13 corresponds to the command path 13 in FIG. 2; a command path 20 corresponds to the command path 20 in FIG. 2; a command path 18 corresponds to the command path 18 in FIG. 2. The command path 15 is connected with the MICOM 19 by way of a resistor 36.

In the circuit configuration unit c corresponding to the AND circuit 16, the emitter terminal of a transistor 25 is connected with the first input terminal a connected with the command path 15; the collector terminal thereof is connected with the command path 13 by way of a resistor 30 and a diode 43; the base terminal thereof is connected with the series connection point between a resistor 31 and a resistor 32. The resistor 31 is connected with the command path 15. The collector terminal of a transistor 26 is connected with the resistor 32; the emitter terminal thereof is connected with the ground level; the base terminal thereof is connected with the second input terminal b by way of a resistor 33.

In the circuit configuration unit d corresponding to the OFF command holding circuit 17, the collector terminal of a transistor 27 is connected with a resistor 34 connected with the command path 15; the emitter terminal thereof is connected with the ground level; the base terminal thereof is connected with the collector terminal of a transistor 28 by way of a resistor 37. The collector terminal of the transistor 28 is connected with a resistor 35 connected with the command path 15; the emitter terminal thereof is connected with the ground level; the base terminal thereof is connected with the collector terminal of a transistor 29 by way of resistors 39 and 40. The collector terminal of the transistor 29 is connected with the second input terminal b of the circuit configuration unit c corresponding to the AND circuit 16; the emitter terminal thereof is connected with the ground level; the base terminal thereof is connected with the command path 18 byway of a resistor 41. A resistor 42 is connected between the command path 18 and the ground level.

In FIG. 3, when the main switch illustrated in FIG. 2 is turned on, a high-level signal as the main relay ON command is inputted through the command path 15 to the first input terminal a of the circuit configuration unit c corresponding to the AND circuit 16 and a high-level signal as the main relay ON command is received through the command path 15 by the circuit configuration unit d corresponding to the OFF command holding circuit 17. Accordingly, the transistors 27 and 28 in the circuit configuration unit d corresponding to the OFF command holding circuit 17 are turned on; then, the output signal as a high-level signal is generated and is inputted to the second input terminal b of the AND circuit 16.

As a result, the circuit configuration c corresponding to the AND circuit 16 outputs an high-level signal and inputs through the command path 13 the high-level signal to the second input terminal of the OR circuit 10 illustrated in FIG. 2. The OR circuit 10 outputs a high-level signal and provides the high-level signal to the base terminal of the load driving transistor 9 so as to turn on the load driving transistor 9. In this situation, because the MICOM 19 has cancelled the main relay OFF command through the command path 18, the transistor 29 is off.

When the MICOM 19 outputs the main relay OFF command through the command path 18, the transistor 29 in the circuit configuration unit d corresponding to the OFF command holding circuit 17 is turned on and hence outputs the main relay OFF command as a low-level signal to the command path 20. Accordingly, the second input terminal b of the circuit configuration unit c corresponding to the AND circuit 16 becomes low-level and hence the transistor 26 becomes off; thus, the transistor 25 becomes off. As a result, the high-level signal that has been inputted to the second input terminal of the OR circuit 10 through the command path 13 is cancelled. In this situation, because the low-level signal lies in the command path 20, the transistor 28 is turned off and hence the transistor 27 is turned on. As a result, even when the starting of the ECU 7 is stopped and the main relay OFF command outputted to the command path 18 by the MICOM 19 is cancelled, the transistor 27 is held to be on through the resistors 35 and 37, as long as the main switch is on and the high-level signal lies in the command path 15. Accordingly, because the transistor 26 becomes off and hence the transistor 25 becomes of, no signal lies in the command path 13; thus, the load driving transistor 9 in FIG. 2 is turned off and hence the off state of the main relay 2 is held.

The operation of the engine control apparatus in FIG. 2, including the circuit configuration illustrated in FIG. 3, according to Embodiment 1 of the present invention and the operation of the vessel propulsion apparatus equipped with the engine control apparatus are as described above.

The engine control apparatus according to Embodiment 1 of the present invention and the vessel propulsion apparatus equipped with the engine control apparatus have been explained heretofore under the assumption that the engine control apparatus is mounted in a small-sized planing boat; however, it goes without saying that the engine control apparatus according to the present invention can be applied to a motorcycle, an outboard engine, or the like. The present invention is not limited to the engine control apparatus according to Embodiment 1 and the vessel propulsion apparatus equipped with the engine control apparatus; in the scope within the spirits of the present invention, the configuration of Embodiment 1 can partially be modified or omitted.

What is claimed is:

1. An engine control apparatus comprising:

an engine control unit including a computer system that performs operation control including starting and stopping of an engine;

a main switch that opens or closes a main power source for supplying a power source to the engine control unit;

an engine starting switch that is turned on when the engine is started;

an engine stopping switch that is turned on when the engine is stopped; and a main relay that supplies a power source from the main power source to the computer system when energized and that stops supply of the power source when de-energized, wherein when the main switch is on, the engine control unit generates a main relay ON command so as to energize the main relay and to supply electric power to the computer system, wherein when the engine starting switch is turned on, the engine control unit starts the engine and generates the main relay ON command so as to continue to energize the main relay, and wherein when the engine stopping switch is turned on, the engine control unit stops the engine, generates a main relay OFF command so as to de-energize the main relay in order to stop supply of electric power to the computer system even when the main switch is on, and continues to generate the main relay OFF command even after the engine stops.

2. The engine control apparatus according to claim 1, wherein in the case where when the main switch is on and generation of the main relay OFF command is continued, the engine starting switch is turned on, the engine control unit energizes the main relay so as to start supply of the power source to the computer system.

3. A vessel equipped with the engine control apparatus according to claim 1.

4. The vessel according to claim 3, further including a handle portion to be operated by an operator who steers a vessel, wherein in the vessel, the main switch is provided at a portion other than the handle portion, and wherein the engine starting switch and the engine stopping switch are provided at the handle portion.

* * * * *